US007053033B2

(12) United States Patent
Scheper

(10) Patent No.: US 7,053,033 B2
(45) Date of Patent: May 30, 2006

(54) TREATMENT OF FABRIC ARTICLES WITH SPECIFIC FABRIC CARE ACTIVES AND A SILOXANE LIPOPHILIC FLUID

(75) Inventor: William Michael Scheper, Lawrenceburg, IN (US)

(73) Assignee: Procter & Gamble Company, Cincinnati, OH (US)

( * ) Notice: Subject to any disclaimer, the term of this patent is extended or adjusted under 35 U.S.C. 154(b) by 557 days.

(21) Appl. No.: 10/757,068

(22) Filed: Jan. 14, 2004

(65) Prior Publication Data

US 2004/0142839 A1 Jul. 22, 2004

Related U.S. Application Data

(63) Continuation of application No. 10/320,872, filed on Dec. 17, 2002, now Pat. No. 6,734,153.

(60) Provisional application No. 60/342,713, filed on Dec. 20, 2001.

(51) Int. Cl.
*C11D 9/36* (2006.01)

(52) U.S. Cl. ..... 510/285; 510/276; 510/286; 510/287; 510/288; 510/289; 510/290; 510/304; 510/466; 510/470; 510/471; 510/473

(58) Field of Classification Search ..... 510/285, 510/276, 286, 287, 288, 289, 290, 304, 466, 510/470, 471, 473
See application file for complete search history.

(56) References Cited

U.S. PATENT DOCUMENTS

| | | | | | |
|---|---|---|---|---|---|
| 3,671,441 | A | | 6/1972 | Basch | |
| 4,102,824 | A | | 7/1978 | Mizutani et al. | |
| 4,549,880 | A | * | 10/1985 | Hendrix et al. | 8/115.52 |
| 4,639,321 | A | | 1/1987 | Barrat et al. | |
| 4,659,332 | A | | 4/1987 | Hellsten et al. | |
| 4,685,930 | A | * | 8/1987 | Kasprzak | 8/139.1 |
| 4,708,807 | A | * | 11/1987 | Kemerer | 510/287 |
| 5,057,240 | A | | 10/1991 | Madore et al. | |
| 5,196,132 | A | | 3/1993 | Mains | |
| 5,705,562 | A | | 1/1998 | Hill et al. | |
| 5,707,613 | A | | 1/1998 | Hill et al. | |
| 5,865,852 | A | | 2/1999 | Berndt et al. | |
| 5,876,510 | A | | 3/1999 | Kuemin et al. | |
| 5,888,250 | A | | 3/1999 | Hayday et al. | |
| 5,942,007 | A | * | 8/1999 | Berndt et al. | 8/142 |
| 5,977,040 | A | | 11/1999 | Inada et al. | |
| 5,985,810 | A | | 11/1999 | Inada et al. | |
| 6,013,683 | A | | 1/2000 | Hill et al. | |
| 6,042,617 | A | | 3/2000 | Berndt et al. | |
| 6,042,618 | A | | 3/2000 | Berndt et al. | |
| 6,056,789 | A | | 5/2000 | Berndt et al. | |
| 6,059,845 | A | | 5/2000 | Berndt et al. | |
| 6,060,546 | A | | 5/2000 | Powell et al. | |
| 6,063,135 | A | | 5/2000 | Berndt et al. | |
| 6,136,766 | A | | 10/2000 | Inada et al. | |
| 6,156,074 | A | | 12/2000 | Hayday et al. | |
| 6,177,399 | B1 | | 1/2001 | Mei et al. | |
| 6,200,352 | B1 | | 3/2001 | Romack | |
| 6,258,130 | B1 | | 7/2001 | Murphy et al. | |
| 6,273,919 | B1 | | 8/2001 | Hayday et al. | |
| 6,309,425 | B1 | | 10/2001 | Murphy et al. | |
| 6,310,029 | B1 | | 10/2001 | Kilgour | |
| 6,313,079 | B1 | | 11/2001 | Murphy | |
| 6,368,359 | B1 | | 4/2002 | Perry et al. | |
| 6,482,784 | B1 | * | 11/2002 | Murphy et al. | 510/285 |
| 6,521,580 | B1 | * | 2/2003 | Perry et al. | 510/285 |
| 6,548,465 | B1 | * | 4/2003 | Perry et al. | 510/285 |
| 6,670,317 | B1 | * | 12/2003 | Severns et al. | 510/285 |
| 6,673,764 | B1 | * | 1/2004 | Severns et al. | 510/419 |
| 6,706,076 | B1 | * | 3/2004 | Deak et al. | 8/137 |
| 6,706,677 | B1 | * | 3/2004 | Burns et al. | 510/286 |
| 2001/0020308 | A1 | | 9/2001 | Murphy et al. | |
| 2001/0034912 | A1 | | 11/2001 | Kilgour et al. | |
| 2002/0004953 | A1 | | 1/2002 | Perry et al. | |
| 2002/0115582 | A1 | | 8/2002 | Perry et al. | |
| 2002/0174493 | A1 | | 11/2002 | Perry et al. | |

FOREIGN PATENT DOCUMENTS

| | | | |
|---|---|---|---|
| DE | 37 39 711 | A1 | 6/1989 |
| EP | 0982 023 | A2 | 3/2000 |
| EP | 1 041 189 | A1 | 10/2000 |
| EP | 1 043 443 | A1 | 10/2000 |
| EP | 1092 803 | A1 | 4/2001 |
| JP | 2000-290689 | | 10/2000 |
| WO | WO 00/04221 | | 1/2000 |
| WO | WO 00/04222 | | 1/2000 |
| WO | WO 00/63340 | | 10/2000 |
| WO | WO 01/40567 | A1 | 6/2001 |
| WO | WO 01/94521 | A1 | 12/2001 |
| WO | WO 01/94678 | A1 | 12/2001 |
| WO | WO 01/94681 | A1 | 12/2001 |
| WO | WO 01/94683 | A1 | 12/2001 |
| WO | WO 01/94684 | A1 | 12/2001 |
| WO | WO 01/94685 | | 12/2001 |
| WO | WO 02/97024 | | 5/2002 |
| WO | WO 02/46517 | A1 | 6/2002 |
| WO | WO 02/48447 | A1 | 6/2002 |
| WO | WO 02/50366 | A1 | 6/2002 |
| WO | WO 02/77356 | A1 | 10/2002 |

* cited by examiner

*Primary Examiner*—Charles Boyer
(74) *Attorney, Agent, or Firm*—Caroline Wei-Berk; C. Brant Cook; Kim W. Zerby

(57) ABSTRACT

Methods and compositions to treat fabrics with lipophilic fluid and a specific fabric care active are provided by the present invention.

27 Claims, No Drawings

TREATMENT OF FABRIC ARTICLES WITH SPECIFIC FABRIC CARE ACTIVES AND A SILOXANE LIPOPHILIC FLUID

RELATED APPLICATIONS

This application is a continuation application of U.S. application Ser. No. 10/320,872, filed Dec. 17, 2002, now U.S. Pat. No. 6,734,153, which claims priority to U.S. Provisional Application Ser. No. 60/342,713 filed Dec. 20, 2001.

FIELD OF THE INVENTION

The present invention relates to compositions and methods to treat fabrics with a lipophilic fluid and a specific fabric care active.

BACKGROUND OF THE INVENTION

Conventional laundering techniques for the cleaning and treatment of fabric articles such as garments have long involved both traditional aqueous based washing and a technique commonly referred to as "dry cleaning". Traditional aqueous based washing techniques have involved immersion of the fabric articles in a solution of water and detergent or soap products followed by rinsing and drying. However, such conventional immersion cleaning techniques have proven unsatisfactory on a wide range fabric articles that require special handling and/or cleaning methods due to fabric content, construction, etceteras, that is unsuitable for immersion in water.

Accordingly, the use of the laundering method of "dry cleaning" has been developed. Dry cleaning typically involves the use of non-aqueous, lipophilic fluids as the solvent or solution for cleaning. While the absence of water permits the cleaning of fabrics without the potential disastrous side effects water may present, these lipophilic fluids do not perform well on hydrophilic and/or combination soils.

Because these lipophilic fluids are typically used in "neat" form (i.e. they contain no additional additives), dry cleaners must often perform pre-treating and/or pre-spotting to remove tough soils from fabrics prior to the dry cleaning cycle. Further, nothing is typically added to boost "whiteness" or "brightness" in fabrics that are dry-cleaned as can be observed from "dingy" or "dull" fabrics returned from a dry cleaner. It would be desirable to add bleaching to the lipophilic fluid treatment regimen in order to increase the lipophilic fluids' brightening, whitening, and/or soil removal capability thereby reducing or eliminating the need for pre-treating and/or pre-spotting.

Many fabrics and textiles highly valued by the consumer (e.g., silk) are prone to undue damage when exposed to water in large quantities. For this reason garments made from such fabric and textiles must be dry cleaned.

Accordingly, the need remains for fabric care and/or treatment regimens for use with lipophilic fluid compositions that incorporate fabric care actives.

SUMMARY OF THE INVENTION

This need is met by the present invention wherein fabric care active-containing care and treatment regimens and compositions for use with lipophilic fluid compositions are provided.

The present invention is directed to a method for attaining improved fabric cleaning in a lipophilic fluid treatment regimen, wherein the method includes the steps of exposing the fabric to a lipophilic fluid and exposing the fabric to a specific fabric care active.

The present invention is also directed to a composition for attaining improved fabric cleaning in a lipophilic fluid treatment regimen, wherein the composition includes a lipophilic fluid and a specific fabric care active.

These and other aspects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All measurements are in SI units unless otherwise specified. All documents cited are in relevant part, incorporated herein by reference.

DETAILED DESCRIPTION OF THE INVENTION

Definitions

The term "fabrics" and "fabric" used herein is intended to mean any article that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The term "soil" means any undesirable substance on a fabric article that is desired to be removed. By the terms "water-based" or "hydrophilic" soils, it is meant that the soil comprised water at the time it first came in contact with the fabric article, or the soil retains a significant portion of water on the fabric article. Examples of water-based soils include, but are not limited to beverages, many food soils, water soluble dyes, bodily fluids such as sweat, urine or blood, outdoor soils such as grass stains and mud.

Lipophilic Fluid

The lipophilic fluid herein is one having a liquid phase present under operating conditions of a fabric article treating appliance, in other words, during treatment of a fabric article in accordance with the present invention. In general such a lipophilic fluid can be fully liquid at ambient temperature and pressure, can be an easily melted solid, e.g., one which becomes liquid at temperatures in the range from about 0 deg. C. to about 60 deg. C., or can comprise a mixture of liquid and vapor phases at ambient temperatures and pressures, e.g., at 25 deg. C. and 1 atm. pressure. Thus, the lipophilic fluid is not a compressible gas such as carbon dioxide.

It is preferred that the lipophilic fluids herein be nonflammable or have relatively high flash points and/or low VOC (volatile organic compound) characteristics, these terms having their conventional meanings as used in the dry cleaning industry, to equal or, preferably, exceed the characteristics of known conventional dry cleaning fluids.

Moreover, suitable lipophilic fluids herein are readily flowable and nonviscous.

In general, lipophilic fluids herein are required to be fluids capable of at least partially dissolving sebum or body soil as defined in the test hereinafter. Mixtures of lipophilic fluid are also suitable, and provided that the requirements of the Lipophilic Fluid Test, as described below, are met, the lipophilic fluid can include any fraction of dry-cleaning solvents, especially newer types including fluorinated solvents, or perfluorinated amines. Some perfluorinated amines such as perfluorotributylamnines while unsuitable for use as lipophilic fluid may be present as one of many possible adjuncts present in the lipophilic fluid-containing composition.

Other suitable lipophilic fluids include, but are not limited to, diol solvent systems e.g., higher diols such as C6- or C8- or higher diols, organosilicone solvents including both cyclic and acyclic types, and the like, and mixtures thereof.

A preferred group of nonaqueous lipophilic fluids suitable for incorporation as a major component of the compositions of the present invention include low-volatility nonfluorinated organics, silicones, especially those other than amino functional silicones, and mixtures thereof. Low volatility nonfluorinated organics include for example OLEAN® and other polyol esters, or certain relatively nonvolatile biodegradable mid-chain branched petroleum fractions.

Another preferred group of nonaqueous lipophilic fluids suitable for incorporation as a major component of the compositions of the present invention include, but are not limited to, glycol ethers, for example propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether. Suitable silicones for use as a major component, e.g., more than 50%, of the composition include cyclopentasiloxanes, sometimes termed "D5", and/or linear analogs having approximately similar volatility, optionally complemented by other compatible silicones. Suitable silicones are well known in the literature, see, for example, Kirk Othmer's Encyclopedia of Chemical Technology, and are available from a number of commercial sources, including General Electric, Toshiba Silicone, Bayer, and Dow Corning. Other suitable lipophilic fluids are commercially available from Procter & Gamble or from Dow Chemical and other suppliers.

Qualification of Lipophilic Fluid and Lipophilic Fluid Test (LF Test)

Any nonaqueous fluid that is both capable of meeting known requirements for a dry-cleaning fluid (e.g, flash point etc.) and is capable of at least partially dissolving sebum, as indicated by the test method described below, is suitable as a lipophilic fluid herein. As a general guideline, perfluorobutylamine (Pluorinert FC43®) on its own (with or without adjuncts) is a reference material which by definition is unsuitable as a lipophilic fluid for use herein (it is essentially a nonsolvent) while cyclopentasiloxanes have suitable sebum-dissolving properties and dissolves sebum.

The following is the method for investigating and qualifying other materials, e.g., other low-viscosity, free-flowing silicones, for use as the lipophilic fluid. The method uses commercially available Crisco® canola oil, oleic acid (95% pure, available from Sigma Aldrich Co.) and squalene (99% pure, available from J.T. Baker) as model soils for sebum. The test materials should be substantially anhydrous and free from any added adjuncts, or other materials during evaluation.

Prepare three vials, each vial will contain one type of lipophilic soil. Place 1.0 g of canola oil in the first; in a second vial place 1.0 g of the oleic acid (95%), and in a third and final vial place 1.0 g of the squalene (99.9%). To each vial add 1 g of the fluid to be tested for lipophilicity. Separately mix at room temperature and pressure each vial containing the lipophilic soil and the fluid to be tested for 20 seconds on a standard vortex mixer at maximum setting. Place vials on the bench and allow to settle for 15 minutes at room temperature and pressure. If, upon standing, a clear single phase is formed in any of the vials containing lipophilic soils, then the nonaqueous fluid qualifies as suitable for use as a "lipophilic fluid" in accordance with the present invention. However, if two or more separate layers are formed in all three vials, then the amount of nonaqueous fluid dissolved in the oil phase will need to be further determined before rejecting or accepting the nonaqueous fluid as qualified.

In such a case, with a syringe, carefully extract a 200-microliter sample from each layer in each vial. The syringe-extracted layer samples are placed in GC auto sampler vials and subjected to conventional GC analysis after determining the retention time of calibration samples of each of the three models soils and the fluid being tested. If more than 1% of the test fluid by GC, preferably greater, is found to be present in any one of the layers which consists of the oleic acid, canola oil or squalene layer, then the test fluid is also qualified for use as a lipophilic fluid. If needed, the method can be further calibrated using heptacosafluorotributylamine, i.e., Fluorinert FC43 (fail) and cyclopentasiloxane (pass). A suitable GC is a Hewlett Packard Gas Chromatograph HP5890 Series II equipped with a split/splidess injector and FID. A suitable column used in determining the amount of lipophilic fluid present is a J&W Scientific capillary column DB-IHT, 30 meter, 0.25mm id, 0.1μm film thickness cat# 1221131. The GC is suitably operated under the following conditions:

Carrier Gas: Hydrogen

Column Head Pressure: 9 psi

Flows: Column Flow @ ~1.5 ml/min.
Split Vent @ ~250–500 ml/min.
Septum Purge @ 1 ml/min.

Injection: HP 7673 Autosampler, 10 μl syringe, 1μl injection

Injector Temperature: 350° C.

Detector Temperature: 380° C.

Oven Temperature Program: initial 60° C. hold 1 min.
rate 25° C./min.
final 380° C. hold 30 min.

Preferred lipophilic fluids suitable for use herein can further be qualified for use on the basis of having an excellent garment care profile. Garment care profile testing is well known in the art and involves testing a fluid to be qualified using a wide range of garment or fabric article components, including fabrics, threads and elastics used in seams, etc., and a range of buttons. Preferred lipophilic fluids for use herein have an excellent garment care profile, for example they have a good shrinkage and/or fabric puckering profile and do not appreciably damage plastic buttons. Certain materials which in sebum removal qualify for use as lipophilic fluids, for example ethyl lactate, can be quite objectionable in their tendency to dissolve buttons, and if such a material is to be used in the compositions of the present invention, it will be formulated with water and/or other solvents such that the overall mix is not substantially damaging to buttons. Other lipophilic fluids, D5, for example, meet the garment care requirements quite admirably. Some suitable lipophilic fluids may be found in granted U.S. Pat. Nos. 5,865,852; 5,942,007; 6,042,617; 6,042,618; 6,056,789; 6,059,845; and 6,063,135, which are incorporated herein by reference.

Lipophilic fluids can include linear and cyclic polysiloxanes, hydrocarbons and chlorinated hydrocarbons, with the exception of PERC and DF2000 which are explicitly not covered by the lipophilic fluid definition as used herein. More preferred are the linear and cyclic polysiloxanes and hydrocarbons of the glycol ether, acetate ester, lactate ester families. Preferred lipophilic fluids include cyclic siloxanes having a boiling point at 760 mm Hg. of below about 250° C. Specifically preferred cyclic siloxanes for use in this invention are octamethylcyclotetrasiloxane, decamethylcyclopentasiloxane, and dodecamethylcyclohexasiloxane. Preferably, the cyclic siloxane comprises decamethylcyclopentasiloxane (D5, pentamer) and is substantially free of octamethylcyclotetrasiloxane (tetramer) and dodecamethylcyclohexasiloxane (hexamer).

However, it should be understood that useful cyclic siloxane mixtures might contain, in addition to the preferred cyclic siloxanes, minor amounts of other cyclic siloxanes including octamethylcyclotetrasiloxane and hexamethylcyclotrisiloxane or higher cyclics such as tetradecamethylcycloheptasiloxane. Generally the amount of these other cyclic siloxanes in useful cyclic siloxane mixtures will be less than about 10 percent based on the total weight of the mixture. The industry standard for cyclic siloxane mixtures is that such mixtures comprise less than about 1% by weight of the mixture of octamethylcyclotetrasiloxane.

Specific Fabric Care Actives

Nonlimiting examples of specific fabric care actives for use in the methods and compositions of the present invention include, UV protection agents, dye transfer inhibiting agents and/or dye fixing agents, amino-containing softening agents, non-amino-containing softening agents, wrinkle reducing and/or removing agents, fabric rebuild agents, fiber repair agents, perfume release and/or delivery agents, shape retention agents, fabric and/or soil targeting agents, antibacterial agents, hygiene agents, irritant reducing agents, anti-discoloring agents, hydrophobic finishing agents and mixtures thereof. Various specific fabric care actives can be used depending upon the desired benefit. The specific fabric care actives will be present in the compositions at a suitable level, known to those of ordinary skill in the art and as described in the references herein, which are incorporated by reference.

Nonlimiting examples of suitable UV protection agents include benzopyrrolidone derivatives (WO 00/65142); sacrificial photofading prevention to retard color fading and/or cinnamate derivatives such as levafix in combination with di-long chain quats (WO 00/00577); aminonapthalene derivatives: fabric substantive sunscreens (WO 99/50379); deposition of UV absorbers via cellulose monoacetate; methoxy cinnamate derivatives (WO 00/18861 and WO 00/18862); esters of PVA and/or SCMC with UV absorbers to enhance active deposition (WO 00/18863); deposition of 2 ethylhexyl 4 methoxy cinnamate in non-ionic/cationic product (WO 97/44422); deposition of UV absorbers of ClogP>4 from rinse products (WO 97/44424); cationic UV absorbers (WO 98/30663); use of hindered amines to retard UV fading of dyed fabrics (WO 01/38470 and WO 01/07550); cationic singlet oxygen quenchers to retard photofading (EP 832 967); NCO containing polymers in combination with water soluble sunscreens (WO 98/49259); antioxidant+linuvin in rinse conditioner (U.S. Pat. No. 5,962,402); benzotriazole UV absorbers (U.S. Pat. No. 5,733,855).

Nonlimiting examples of suitable dye transfer inhibiting (DTI) agents and/or dye fixing agents include black dye to restore fabric color (WO 99/66019); vinyl-imidazole-acrylic acid copolymers as DTI agents (WO 00/17296); llama UHH antibodies to prevent Red 6 dye transfer (WO 99/46300); acrylic/vinylimidazole copolymers as DTI agents (WO 98/30664); compositions containing selected DTI agents and silica or zeolite as a carrier material; Chromabond+Gasil silica or zeolite; Tinofix; Burcofix; PVP (N-polyvinylpyrrolidone); photoinitiators; hydroxyacetophenone; phosphine oxide derivatives; compositions with reactive polymer (eg resin) and reactive anionic polymer and carrier for improved dye fix. (WO 01/25386); PVP/PVI (N-vinylpyrrolidone/N-vinylimidazole copolymer) compositions (U.S. Pat. No. 5,977,046 and WO 97/23591); hyperbranched polymer/dendrimer (EP 875 521); dendritic macromolecule, amine containing (U.S. Pat. No. 5,872,093 and EP 779 358); propylenediamine and piperazine (WO 00/15745) for dye fixing benefits; CMC combinations to reduce fiber mechanical damage and dye loss (WO 00/22079, WO 00/22078, WO 00/22077 and WO 00/22075); dimethyl diallyl based polymers as dye fixing agents (WO 00/56849); polymeric cyclic amines (WO 99/14299); copolymers of epichlorhydrin and cyclic amines together with semi polar nonionics (WO 01/32815 and WO 01/32816); high molecular weight polymers of N-vinylimidazolelNvinylpyrrolidone as DTI agent (DE 19 621 509); polycationics as dye fixatives (DE 19 643 281); aminosilicones as dye removal protectors and prolonged perfume release (WO 98/39401) and mixtures thereof.

Nonlimiting examples of suitable amino softening agents include triethanolamine esterified with carboxylic acid and quatemized; also UV absorbing (EP 902 009); esterquats (WO 99/58492); cationic diesters: 1,2 dihydroxy 3 trimethylamino propane chloride (U.S. Pat. No. 4,137,180); betaine esters of long chain Guerbet alcohols as softening agents (WO 97/08284); pentaerythritol esterquats (EP 790 295); fabric softener compositions containing cyclic polyols and/or reduced saccharides and/or deposition aid, and/or containing anionic/non-ionic+cationic polymer with overall net negative charge (WO 00/70004 and WO 00/70005); fabric softener compositions with cationic and oily sugar derivative, optionally containing a deposition aid (WO 01/46361 and WO 01/46363); tertiary amine/esterquat combinations (JP 11-350348 and WO 99/64661 and WO 99/64660 and JP 11-350349); biodegradable esterquats (IP 11-246502); tertiary amnide/esterquat amino softening compositions, and amido esterquats (JP11-081134 and JP 11-043863); chlorocarboxylic acid derived esterquats (JP 09-104664); cetyl/stearyl Guerbet alcohol derived quat (JP 09-188654); hydroxystearic acid/stearylamine derivatives (JP 09-110814); aminopropanediol derivatives (JP 09-255638); Guerbet alcohol derivatives (JP 09-295960); malic acid derivatives (JP 09-301936); quaternary amnnonium amides (JP 09-278728); esterquat softener (WO 01/02338); polyanines as effective softening agents, includes propylene diamine derivatives and 1,4 piperazine derivatives (WO 00/15746); benzoate/salicylate salts of di-long chain quats (EP 955 288); ester quats with multiple EO/PO/BO groups (WO 00/68502); hexamethylene diamine based quats (U.S. Pat. No. 6,211,139) and mixtures thereof.

Nonlimiting examples of non-amino softening agents include aminosilicones (U.S. Pat. No. 4,891,166); quat/silicone compositions containing Bronsted acid in liquid detergent (EP 459 821); fabric softener with high viscosity silicone, provides EOI benefits, for example a composition containing a cationic, perfume of silicone of specified emulsion droplet size (WO 01/71806 and WO 00/71807); non-ionic softener, esterified cyclic polyol or reduced sacharide (WO 01/07546); quat composition containing silicone and a skin benefit agent (EP 789 070); composition containing a silicone quat and cationic polymer (e.g., guar) as a deposition aid (EP 530 974); modified PDMS for improved fiber flexibility (JP 2000-64180); softening compositions containing PDMS with pendant ethoxy amido groups (JP 2000-144199); improved textile feel with functionalized PDMS containing pendant amino functionality, can include alcohol addition (JP 2000-178583 and JP 2000-192075); cationic amino silicone agents; aminosilicone detergent compositions (EP 150 872); amino silicone/fabric softening compositions (WO 92/01773 and U.S. Pat. No. 4,800,026); silicone aminoesters as softeners (U.S. Pat. No. 5,668,102); PDMS/quat compositions (WO 01/25381); functionalized siloxanes for hydrophilicity, softening and resistance to yellowing (U.S. Pat. No. 6,136,215 and EP 1 081 272); quatemized silicones to provide textile finishing and soil release (U.S. Pat. No. 4,448,810); PDMS blends of high and low viscosity polymers (EP 422 787); biodegradable organosilicones good softening agents (WO 01/23394); silicones with pendant amino groups in fiber conditioning compositions (EP 413 416); polyquaternary polysiloxane polymer; cationic silicone with repeat N+units (U.S. Pat. No. 4,891,166); amino silicones with pendant EO/PO and epoxy glucamine side chains (EP 879 840); particles of coated aminosilicone (WO 99/38911); aminosilicone compositions and method of laundering (WO 98/39401); block copolymers of PDMS and EO/PO units (WO 97/32917); aminosilicones with low amine number, for reduced yellowing (U.S. Pat. No. 5,593,611) and mixtures thereof.

Nonlimiting examples of suitable wrinkle reducing and/or removing agents include use of oxidised polyethylene in fabric softener for ease of iron benefits (DE19 926 863); sulfated castor oil and/or ethoxylated silicones and/or amino PDMS and/or polyacrylamides as anti wrinkle agents and HDL detergents containing them; Magnasoft SRS, Silwet L-7622 (WO 00/24853 and WO 00/24857); tumble dryer sheets containing ethoxylated PDMS and acrylic polymers (WO 00/27991); emulsion of high viscosity silicone oil and esterquat to provide wrinkle reduction (WO 00/71806); aliphatic unsaturated hydrocarbons applied via dryer sheet; squalene; paraffin (WO 01/34896); thermoplastic polymer coated onto fabric; styrene-isoprene or styrene butadiene polymers (WO 01/38627); incorporation of silicone polymers into crosslinked cellulose; silicone carboxylates or silanol containing reacted with acid treated cellulose (WO 01/44426); carrier sheet with fabric treatment composition for clothes revival, for example a carrier sheet containing a tear off portion for stain pre-treatment (WO 01/07561 and WO 01/07562); wrinkle reducing technologies; acrylics with PDMS; arabinogalactans; silicone emulsions; isomaltosuccinamides (WO 00/24851 and WO 00/24856 and WO 00/24858); natural cotyledon extract (WO 01/07554); cellulosic based anti-wrinkle technology containing triazine or pyrimidine units and a cross linking agent (WO 01/23660); cationic polyamide/epichlorhydrin resin and silicone lubricant compositions in anti-wrinkle spray (EP 1 096 056); wrinkle reducing compositions containing silicone and film forming polymer; wide range of silicones disclosed (WO 96/15309); wrinkle reducing compositions containing nonionic polyhydric alcohol (WO 99/55948 and WO 99/55949); curable aminofunctionalized silicone/fabric softening compositions as effective wrinkle reducing aid (U.S. Pat. No. 5,174,912); polyacrylate/dihydroxyethylurea as wrinkle reducing agents (WO 01/16262) and mixtures thereof.

Nonlimiting examples of fabric rebuild agents and/or fiber repair agents include production of N-alkoxylated chitin/chitosan as reviving agent (DE 10 019 140); cellulose monoacetate as fabric rebuild agent, such as the use of cellulosic polymers as deposition aids for various benefit agents (WO 00/18860, WO 00/18861 and WO 00/18862); cationic polyamine/epichlorhydrin resin crosslinked as fabric rebuild agent; Apomul SAK (WO 01/25386); polymeric materials capable of self crosslinking or reacting with cellulose; includes reactive polyurethanes (WO 01/27232); compositions containing polyssacharide gum of low molecular weight such as locust bean gum, such gums can be produced in situ via enzyme cleavage, such as Xyloglucans (WO 00/40684 and WO 00/40685); polysaccharide/cellulose ester (acetate); specific substituted rebuild polymers (WO 01/72936 and WO 01/72940 to WO 01/72944); hydrophobized CMC to prevent fibre entanglement (WO 00/42144 and WO 00/47705); high molecular weight PEIs crosslinked with dibasic acids or epichlorhydrin for abrasion resistance (WO 00/49122); propylene diamine polymer derivatives for abrasion resistance (WO 00/49123); lysine caprolactam polymers for abrasion resistance (WO 00/49125); film forming cellulose ethers applied from rinse conditioner (WO 00/65015); lysine/amine or adipic acid copolymers for fiber appearance (WO 99/07813 and WO 99/07814) and mixtures thereof.

Nonlimiting examples of suitable perfume release and/or delivery agents include improved retention of perfume to surface via use of cationic esterquat (DE 19 919 088); delayed release of perfume via granule incorporation (DE 19 948 667); perfume encapsulates containing crosslinked polystyrene (WO 00/68352); perfume/silica particles (EP 820 762); perfume composition which deposits preferentially on Spandex (WO 99/19452); domestic care product containing perfume particle+silicone polymer for fragrance longevity (WO 01/25389); sustained release acetoaldehyde carrier (JP 2001-072637); betaine ester derivatives (EP 1 099 689); perfume compositions containing methyl β-cyclodextrins (WO 00/67719 and WO 00/67720 and WO 00/67721); profragrances containing β-amino ketones and oxazolidines (WO 00/63339); encapsulated bloodying perfumes (U.S. Pat. No. 6,143,707); linear and cyclic acetals, ortho carbonate esters (WO 99/00347 and WO 99/00377 and WO 98/47995); p-toluene sulfonate esters for sustained perfume release (WO 97/22580); aminoester derivatives of perfumery alcohols (WO 97/16407); enduring perfumes characterized by component ClogP>3 (WO 97/31094); succinate and fumarate esters of perfumery alcohols (U.S. Pat. No. 5,668,102); acetals and ketals (WO 97/34981 and WO 97/34986); β-keto esters of perfumery alcohols and applications (WO 98/07405 and WO 98/07813); imines as fragrance delivery vehicle, process of making same (EP 1 067 116 and EP 1 067 117); β-keto esters (EP 911 315); esters, enol esters and carbonates as perfume precursors (WO 98/58899 and EP 887 335 and EP 887 338); organosiloxane from phenylehther ester of penteneoic acid for delayed perfume release (EP 878 497); softener compositions containing properfume and enzyme for cleaving properfume (EP 1 077 251); perfume capsules for controlled fragrance release (U.S. Pat. No. 6,147,046 and U.S. Pat. No. 6,142,398); ester properfume compound; contains secondary carbamoyl functionality (WO 01/28980); α-keto ester properfume; triggered by light (U.S. Pat. No. 6,218,355); fragrance releasing siloxane containing PDMS functionalized with fragrance alcohols (EP 982 022); perfume specification to mask enzyme odor (JP 2000-230197); cucurtiburils, alternatives to cyclodextrins (WO 00/68232); perfume encapsulates, containing copolymer of terephthalic acid, sulfoisophthalic acid and ethylene glycol (FR 2 791 906, FR 2 791 992 and WO 01/23512) and mixtures thereof.

Nonlimiting examples of suitable shape retention agents include compositions containing PAE resin (e.g., Apomul SAK) and silicone to provide dimensional stability (WO 00/15747 and WO 00/15748); cationic aminetepichlorhydrin resin (PAE resin) as fabric shape retention agents for dryer applications (WO 00/15755); anionic polymer capable of self cross linking and reacting with cellulose, eg carbamoyl sulfonate terminated blocked isocyanates; provide dimensional stability (WO 01/25387) and mixtures thereof.

Nonlimiting examples of suitable targeting agents (technologies) include attachment of large molecules to cellulose binding polysaccharides (WO 99/36469); attachment of antibodies to functional material and adsorption onto fabric surface (WO 01/46364 and WO 01/48135); proteins having a cellulosic binding domain (CBD) attached to particles via antibody link, enhancement of perfume containing coacervates onto cotton (WO 01/46357); delivery of benefit agent to fabric via peptide or protein deposition aid (WO 98/00500); benefit agent attached to mimic cellulose binding domain (WO 01/34743 and WO 01/32848) and mixtures thereof.

Nonlimiting examples of suitable irritant reducing agents include reduced irritancy of as laundered fabrics via treatment with Lever quaternary ammonium materials (WO 00/17297).

Nonlimiting examples of suitable anti-discoloring agents include phosphonated terminated polyacrylate to provide lower yellowing potential during fabric bleaching (DE 19 904 230).

Nonlimiting examples of suitable hydrophobic finishing agents include polylysine as hydrophobic finishing agent (DE 19 902 506).

Nonlimiting examples of suitable antibacterial agents include combination of amber and musk materials to mask malodor (WO 98/56337); antibacteriocidal compositions containing 5-chlorosalicylanilide (WO 01/60157); antimicrobial compositions containing aminoalkyl silicone, improved surface residuality (WO 96/19194); antimicrobial polypeptides (WO 96/28468); antimicrobial compositions containing aromatic alcohols and phenols (WO 98/01524); antimicrobial activity of alcohols (WO 97/21795); betaine compositions with good antimicrobial activity (WO 97/43368 and WO 97/43369); high pH non-ionic solutions as antimicrobial agents (WO 01/44430); capsule for controlled release of textile treatment agents (DE 19 931 399); composition containing benzylakylammonium, zinc PTO, climbazole (WO 98/01527); alkyldimethylammonium and alcohol ehtoxylates as effective antibacterial compositions (GB 2 322 552); cyclohexyl esters for odor neutralization (WO 01/43784); alkoxy disulphide antimicrobial agents (EP 1 008 296); bromofuranones as antibacterial agents (WO 01/43739) and mixtures thereof.

Adjunct Ingredients

In addition to the specific fabric care actives described above, other fabric care actives such as adjunct materials may be used in the methods and compositions of the present invention.

Adjunct materials can vary widely and can be used at widely ranging levels. For example, detersive enzymes such as proteases, amylases, cellulases, lipases and the like as well as bleach catalysts including the macrocyclic types having manganese or similar transition metals all useful in laundry and cleaning products can be used herein at very low, or less commonly, higher levels. Adjunct materials that are catalytic, for example enzymes, can be used in "forward" or "reverse" modes, a discovery independently useful from the specific appliances of the present invention. For example, a lipolase or other hydrolase may be used, optionally in the presence of alcohols as adjuncts, to convert fatty acids to esters, thereby increasing their solubility in the lipophilic fluid. This is a "reverse" operation, in contrast with the normal use of this hydrolase in water to convert a less water-soluble fatty ester to a more water-soluble material. In any event, any adjunct ingredient must be suitable for use in combination with the lipophilic fluid.

The compositions may comprise emulsifiers. Emulsifiers are well known in the chemical art. Essentially, an emulsifier acts to bring two or more insoluble or semi-soluble phases together to create a stable or semi-stable emulsion. It is preferred in the claimed invention that the emulsifier serves a dual purpose wherein it is capable of acting not only as an emulsifier but also as a treatment performance booster. For example, the emulsifier may also act as a surfactant thereby boosting cleaning performance. Both ordinary emulsifiers and emulsifier/surfactants are commercially available.

Some suitable cleaning additives (adjunct ingredients) include, but are not limited to, builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, chelants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, anti-static agents, dye fixatives, dye abrasion inhibitors, anti-crocking agents, wrinkle reduction agents, wrinkle resistance agents, soil release polymers, soil repellency agents, sunscreen agents, anti-fade agents, and mixtures thereof.

The term "surfactant" conventionally refers to materials that are surface-active either in the water, the lipophilic fluid, or the mixture of the two. Some illustrative surfactants include nonionic, cationic and silicone surfactants as used in conventional aqueous detergent systems. Suitable nonionic surfactants include, but are not limited to:

a) Polyethylene oxide condensates of nonyl phenol and myristyl alcohol, such as in U.S. Pat. No. 4,685,930 Kasprzak; and b) fatty alcohol ethoxylates, R—$(OCH_2CH_2)_a$OH a=1 to 100, typically 12–40, R=hydrocarbon residue 8 to 20 C atoms, typically linear alkyl. Examples polyoxyethylene lauryl ether, with 4 or 23 oxyethylene groups; polyoxyethylene cetyl ether with 2, 10 or 20 oxyethylene groups; polyoxyethylene stearyl ether, with 2, 10, 20, 21 or 100 oxyethylene groups; polyoxyethylene (2), (10) oleyl ether, with 2 or 10 oxyethylene groups. Commercially available examples include, but are not limited to: ALFONIC, BRIJ, GENAPOL, NEODOL, SURFONIC, TRYCOL. See also U.S. Pat. No. 6,013,683 Hill et al.,.

Suitable cationic surfactants include, but are not limited to dialkyldimethylammonium salts having the formula:

$$R'R''N^+(CH_3)_2X'$$

Where each R'R" is independently selected from the group consisting of 12–30 C atoms or derived from tallow, coconut oil or soy, X=CI or Br, Examples include: didodecyldimethylammonium bromide (DDAB), dihexadecyldimethyl ammonium chloride, dihexadecyldimethyl ammonium bromide, dioctadecyldimethyl ammonium chloride, dieicosyldimethyl ammonium chloride, dieicosyldimethyl ammonium chloride, dicoconutdimethyl ammonium chloride, ditallowdimethyl ammonium bromide (DTAB). Commercially available examples include, but are not limited to: ADOGEN, ARQUAD, TOMAH, VARIQUAT. See also U.S. Pat. No. 6013683 Hill et al.,.

Suitable silicone surfactants include, but are not limited to the polyalkyleneoxide polysiloxanes having a dimethyl polysiloxane hydrophobic moiety and one or more hydrophilic polyalkylene side chains and have the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxide/propyleneoxide) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Examples of these surfactants may be found in U.S. Pat. No. 5705562 Hill and U.S. Pat. No. 5,707,613 Hill, both of which are incorporated herein by reference.

Examples of this type of surfactants are the Silwet® surfactants which are available CK Witco, OSi Division, Danbury, Conn. Representative Silwet surfactants are as follows.

| Name | Average MW | Average a + b | Average total c |
|---|---|---|---|
| L-7608 | 600 | 1 | 9 |
| L-7607 | 1,000 | 2 | 17 |
| L-77 | 600 | 1 | 9 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units ($—C_2H_4O$) in the polyether chain ($R^1$) must be sufficient to render the polyalkyleneoxide polysiloxane water dispersible or water soluble. If propyleneoxy groups are present in the polyalkylenoxy chain, they can be distributed randomly in the chain or exist as blocks. Preferred Silwet surfactants are L-7600, L-7602, L-7604, L-7605, L-7657, and mixtures thereof. Besides surface activity, polyalkyleneoxide polysiloxane surfactants can also provide other benefits, such as antistatic benefits, and softness to fabrics.

The preparation of polyalkyleneoxide polysiloxanes is well known in the art. Polyalkyleneoxide polysiloxanes of the present invention can be prepared according to the procedure set forth in U.S. Pat. No. 3,299,112, incorporated herein by reference.

Another suitable silicone surfactant is SF-1488, which is available from GE silicone fluids.

These and other surfactants suitable for use in combination with the lipophilic fluid as adjuncts are well known in the art, being described in more detail in Kirk Othmer's Encyclopedia of Chemical Technology, 3rd Ed., Vol. 22, pp. 360–379, "Surfactants and Detersive Systems", incorporated by reference herein. Further suitable nonionic detergent surfactants are generally disclosed in U.S. Pat. No. 3,929,678, Laughlin et al., issued Dec. 30, 1975, at column 13, line 14 through column 16, line 6, incorporated herein by reference.

The adjunct may also be an antistatic agent. Any suitable well-known antistatic agents used in laundering and dry cleaning art are suitable for use in the methods and compositions of the present invention. Especially suitable as antistatic agents are the subset of fabric softeners which are known to provide antistatic benefits. For example those fabric softeners which have a fatty acyl group which has an iodine value of above 20, such as N,N-di(tallowoyl-oxyethyl)-N,N-dimethyl ammonium methylsulfate. However, it is to be understood that the term antistatic agent is not to be limited to just this subset of fabric softeners and includes all antistatic agents.

Although the methods and/or compositions utilized in present invention will be described in detail, it should be understood, and one skilled in the art will recognize, that any compositions, processes, and/or apparatuses capable of carrying out the invention could be used.

Method

The method of the present invention is directed to attaining improved fabric cleaning in a lipophilic fluid treatment regimen, and includes the steps of exposing the fabric to a lipophilic fluid and exposing the fabric to a specific fabric care active. Optionally but preferably, it may include the step of exposing the fabric to a polar phase.

The polar phase may include water, alcohol, or mixtures thereof. If the polar phase does include water, it preferably comprises at least about 0.5% water by weight of fabric and at most about 10% water by weight of fabric.

The lipophilic fluid may comprise a linear siloxane, a cyclic siloxane, or mixtures thereof. Preferably, the lipophilic fluid is selected from the group consisting essentially of octamethylcyclotetrasiloxane, decamethylcyclopentasiloxane, dodecamethylcyclohexasiloxane, and mixtures thereof. Even more preferably, the lipophilic fluid comprises decamethylcyclopentasiloxane. Most preferably, the lipophilic fluid comprises decamethylcyclopentasiloxane and is substantially free of octamethylcyclotetrasiloxane. Due to the flash points of the aforementioned siloxanes, the method preferably occurs at less than about 80° C.

While carrying out the method of the present invention, the fabrics may also be exposed to an emulsifier an/or a surfactant either separately or as a result of being contained within the polar phase, the lipophilic fluid, and/or the bleach system. The fabrics may also be exposed to adjunct ingredients selected from the group consisting essentially of enzymes, bleaches, surfactants, fabric softeners, perfumes, antibacterial agents, antistatic agents, brighteners, dye fixatives, dye abrasion inhibitors, anti-crocking agents, wrinkle reduction agents, wrinkle resistance agents, soil release polymers, sunscreen agents, anti-fade agents, builders, chelants, sudsing agents, composition malodor control agents, composition coloring agents, pH buffers, waterproofing agents, soil repellency agents, and mixtures thereof. These adjuncts can also be applied either separately or as a result of being contained within the polar phase, the lipophilic fluid, and/or the specific fabric care active.

Composition

The composition of the present invention is directed to attaining improved fabric cleaning in a lipophilic fluid treatment regimen, wherein the composition comprises a lipophilic fluid and a specific fabric care active. Optionally, the composition can further comprise a polar phase.

If included, the polar phase may include water, alcohol, and mixtures thereof. Also, the polar phase preferably comprises at least about 0.1% water by weight of composition and at most about 5% water by weight of composition.

Further, the polar phase may comprise a buffer to maintain pH.

The composition may contain non-specific fabric care actives also to stabilize the product during storage prior to delivery in the lipophilic system. Such chelating agents may comprise, but are not limited to, ethylenediaminedisuccunate (EDDS), ethylene diamine tetra acetic acid (EDTA), quatemary ammonia compounds, or 1-Hydroxyethane-1,1-diphosphonic acid (HEDP).

The lipophilic fluid may comprise a linear siloxane, a cyclic siloxane, or mixtures thereof. Preferably, the lipophilic fluid comprises a lipophilic fluid selected from the group consisting essentially of octamethylcyclotetrasiloxane, decamethylcyclopentasiloxane, dodecamethylcyclohexasiloxane, and mixtures thereof. More preferably, the lipophilic fluid comprises decamethylcyclopentasiloxane. Most preferably, the lipophilic fluid comprises decamethylcyclopentasiloxane and is substantially free of octamethylcyclotetrasiloxane.

The bleach system may include oxygen-based bleach, bleach activator and a peroxide source, pre-formed peracid, oxidative bleach enzyme, photo bleach, bleach boosting compounds, metal bleach catalysts, ozone, chlorine dioxide or mixtures of multiple bleach systems. If the bleach system comprises pre-formed peracid the polar phase preferably comprises at least about 1% water by weight of fabric. Preferably, the bleach system has at least about 2 ppm AvO, more preferably at least about 25 ppm AvO, even more preferably at least about 50 ppm AvO, even more preferably at least about 100 ppm AvO. Preferably, the bleach system has at most about 10000 ppm AvO. Most preferably, the bleach system has at least about 100 ppm AvO and at most about 5000 ppm AvO. The bleach system may be within the polar phase and/or within the lipophilic fluid as opposed to being a stand-alone component.

While carrying out the present invention, the fabrics may also be exposed to an emulsifier an/or a surfactant either separately or as a result of being contained within the polar phase, the lipophilic fluid, and/or the bleach system. The fabrics may also be exposed to adjunct ingredients selected from the group consisting essentially of enzymes, bleaches, emulsifiers, surfactants, fabric softeners, perfumes, antibacterial agents, antistatic agents, brighteners, dye fixatives, dye abrasion inhibitors, anti-crocking agents, wrinkle reduction agents, wrinkle resistance agents, soil release polymers, sunscreen agents, anti-fade agents, builders, chelants, sudsing agents, composition malodor control agents, composition coloring agents, pH buffers, waterproofing agents, soil repellency agents, and mixtures thereof. These adjuncts can also be applied either separately or as a result of being contained within the polar phase, the lipophilic fluid, and/or the bleach system.

It will be understood that the methods and/or compositions of the present invention may be combined with other fabric treatments. For example, prior to the application of the lipophilic fluid the fabric articles may be subjected to the particulate removal method described in co-pending application Serial No. 60/191,965, to Noyes et al., filed Mar. 24, 2000, the relevant parts of which are incorporated herein by reference.

The present invention may be used in a service, such as a dry cleaning service, diaper service, uniform cleaning service, or commercial business, such as a Laundromat, dry cleaner, linen service which is part of a hotel, restaurant, convention center, airport, cruise ship, port facility, casino, or may be used in the home.

The methods and/or compositions of the present invention may be performed in an apparatus that is a modified existing apparatus and is retrofitted in such a manner as to conduct the process of the present invention in addition to related processes.

The methods and/or compositions of the present invention may also be performed in an apparatus, which is not a modified existing apparatus but is one specifically built in such a manner so as to conduct the process of the present invention or may be added to another apparatus as part of a lipophilic fluid processing system. This would include all the associated plumbing, such as connection to a chemical and water supply, and sewerage for waste wash fluids.

Finally, the methods of the present invention may be performed in an apparatus, which is not a modified existing apparatus but is one specifically built in such a manner so as to conduct the process the he present invention and related processes.

An apparatus used to carry out the present invention will typically contain some type of control system These include electrical systems, such as, the so-called smart control systems, as well as more traditional electro-mechanical systems. The control systems would enable the user to select the size of the fabric load to be cleaned, the type of soiling, the extent of the soiling, the time for the cleaning cycle. Alternatively, the user could use pre-set cleaning and/or refreshing cycles, or the apparatus could control the length of the cycle, based on any number of ascertainable parameters. This would be especially true for electrical control systems. For example, when the collection rate of lipophilic fluid reaches a steady rate the apparatus could turn its self off after a fixed period of time, or initiate another process for the lipophilic fluid.

In the case of electrical control systems, one option is to make the control device a so-called "smart device". This could mean including, but not limited to, self diagnostic system, load type and cycle selection, linking the machine to the Internet and allowing for the consumer to start the apparatus remotely, be informed when the apparatus has cleaned a fabric article, or for the supplier to remotely diagnose problems if the apparatus should break down. Furthermore, if the apparatus of the present invention is only a part of a cleaning system, the so called "smart system" could be communicating with the other cleaning devices which would be used to complete the remainder of the cleaning process, such as a washing machine, and a dryer.

What is claimed is:

1. A method for treating a fabric article in need of treatment comprising the step of exposing the fabric article with a fabric care composition comprising more than about 50% by weight of the composition of a lipophilic fluid and a softening agent, such that the fabric article is treated;

wherein the lipophilic fluid is selected from the group consisting of a linear siloxane, a cyclic siloxane and mixtures thereof; and the softening agent is selected from the group consisting of triethanolamine esterified with carboxylic acids and quaternized: cationic diester; 1,2 dihydroxy 3 trimethylamino propane chloride; betaine esters of long chain Guerbet alcohols; cyclic polyols; reduced saccharides; tertiary amine/esterquat combinations; tertiary amide/esterquat amino combinations; amino esterquats; cationic and oily sugar derivatives; ester quats; polyamine derivatives; and mixtures thereof.

2. A method according to claim 1 wherein the lipophilic fluid comprises a cyclic siloxane selected from the group consisting of octamethylcyclotetrasiloxane, decamethylcyclopentasiloxane, dodecamethylcyclohexasiloxane, and mixtures thereof.

3. A method according to claim 1 wherein the lipophilic fluid comprises decamethylcyclopentasiloxane.

4. A method according to claim 1 wherein the composition further comprises a polar phase selected from the group consisting of water, alcohol, and mixtures thereof.

5. A method according to claim 4 wherein the polar phase comprises from about 0.1% to about 5% by weight of composition of water.

6. A method according to claim 1 comprising the additional step of exposing the fabric article to an emulsifier.

7. A method according to claim 1 wherein the method occurs at less than about 80° C.

8. A fabric care composition comprising more than about 50% by weight of the composition of a lipophilic fluid selected from the group consisting of a linear siloxane, a cyclic siloxane and mixtures thereof; and a softening agent is selected from the group consisting of a softening agent selected from the group consisting of triethanolamine esterified with carboxylic acids and quaternized: cationic diester; 1,2 dihydroxy 3 trimethylamino propane chloride; betaine esters of long chain Guerbet alcohols; cyclic polyols; reduced saccharides; tertiary amine/esterquat combinations; tertiary amide/esterquat amino combinations; amido esterquats; cationic and oily sugar derivatives; ester quats; polyamine derivatives; and mixtures thereof.

9. A composition according to claim 8 wherein the lipophilic fluid comprises a cyclic siloxane selected from the group consisting of octamethylcyclotetrasiloxane, decamethylcyclopentasiloxane, dodecamethylcyclohexasiloxane, and mixtures thereof.

10. A composition according to claim 8 wherein the lipophilic fluid comprises decamethylcyclopentasiloxane.

11. A composition according to claim 8 wherein the composition further comprises a polar phase selected from the group consisting of water, alcohol, and mixtures thereof.

12. A composition according to claim 11 wherein the polar phase comprises from about 0.1% to about 5% by weight of composition of water.

13. A method for treating a fabric article in need of treatment comprising the step of exposing the fabric article with a fabric care composition comprising more than about 50% by weight of the composition of a lipophilic fluid and a fabric care active, such that the fabric article is treated;

wherein the lipophilic fluid is selected from the group consisting of a linear siloxane, a cyclic siloxane and mixtures thereof; and the fabric care active is selected from the group consisting of oxidized polyethylene, sulfated castor oil, polyacylamides, squalene, paraffin, styrene-isoprene polymers, styrene-butadice polymers, arabinogalactans, isomaltosuccinamides, natural cotyledon extracts, calionic polyamine/epichlorhydrin resin, nonionic polylydric alcohols, polyacrylate/dihydroxyethylurea, N-alkoxylated chitiu/cluitosan, cellulrose, monoacerate, cationic polyamine/epichlorhydrin, polysaccharide gums, polysaccharide/cellulose ester, propylene diamine polymer derivatives, lysine caprolactam polymers, cellulose ethers, lysine/amine of adipic acid copolymers, carharnoyl sulfonate lerroinated block isocyanates, polylysines, phosphonate terminated polyacrylates, and mixture thereof.

14. A method according to claim 13 wherein the lipophilic fluid comprises a cyclic siloxane selected from the group consisting of octamethylcyclotetrasiloxane, decamethylcyclopentasiloxane, dodecamethylcyclohexasiloxane, and mixtures thereof.

15. A method according to claim 13 wherein the lipophilic fluid comprises decamethylcyclopentasiloxane.

16. A method according to claim 13 wherein the composition further comprises a polar phase selected from the group consisting of water, alcohol, and mixture thereof.

17. A method according to claim 16 wherein the polar phase comprises from about 0.1% to about 5% by weight of composition of water.

18. A method according to claim 13 comprising the additional step of exposing the fabric an emulsifier.

19. A method according to claim 13 wherein the method occurs at less than about 80° C.

20. A fabric care composition comprising more than about 50% by weight of the composition of a lipophilic fluid selected from the group consisting of a linear siloxane, a cyclic siloxane and mixtures thereof; and a fabric care active is selected from the group consisting of oxidized polyethylene, sulfated castor oil, polyacylamides, squalene, paraffin, styrene-isoprene polymers, styrene-butadice polymers, arabinogalactans, isomaltosuccinamides, natural cotyledon extracts, calionic polyamine/epichlorhydrin resin, nonionic polylydric alcohols, polyacrylate/dihydroxyethylurea, N-alkoxylated chitiu/cluitosan, cellulrose, monoacerate, cationic polyamine/epichlorhydrin, polysaccharide gums, polysaccharide/cellulose ester, propylene diamine polymer desivatives, lysine caprolactam polymers, cellulose ethers, lysine/amine of adipic acid copolymers, carharnoyl sulfonate lerroinated block isocyanates, polylysines, phosphonate terminated polyacrylates, and mixture thereof.

21. A composition according to claim 20 wherein the lipophilic fluid comprises a cyclic siloxane selected from the group consisting of octamethylcyclotetrasiloxane, decamethylcyclopentasiloxane, dodecamethylcyclohexasiloxane, and mixture thereof.

22. A composition according to claim 20 wherein the lipophilic fluid comprises dodecamethylcyclohexasiloxane.

23. A composition according to claim 20 wherein the composition further comprises a polar phase selected from the group consisting of water, alcohol, and mixture thereof.

24. A composition according to claim 23 wherein the polar phase comprises from about 0.1% to about 5% by weight of composition of water.

25. A fabric care composition comprising more than about 50% by weight of the composition of a lipophilic fluid selected from the group consisting of a linear siloxane, a cyclic siloxane and mixtures thereof; and a fabric care active is selected from the group consisting of amber, musk, chlorosalicylanilides, polypeptides, benzylallaylasnmmonthem, zinc PTO, climbazole, cyclohexyl esters, alkoxy disulfides, bromofuranones, and mixtures thereof.

26. A composition according to claim 25 wherein the composition further comprises a polar phase selected from the group consisting of water, alcohol, and mixture thereof.

27. A composition according to claim 26 wherein the polar phase comprises water and the lipophilic fluid comprises decamethylcyclopentasiloxane.

* * * * *